US005745083A

United States Patent [19]

Uematsu et al.

[11] Patent Number: 5,745,083

[45] Date of Patent: Apr. 28, 1998

[54] SLOTTED LEAKY WAVEGUIDE ARRAY ANTENNA AND A METHOD OF MANUFACTURING THE SAME

[75] Inventors: Masahiro Uematsu; Nobuharu Takahashi; Takashi Ojima, all of Tokyo; Hiroaki Kawaguchi, Odawara; Yutaka Arai, Tokyo; Yoshikazu Takahashi, Odawara; Seiji Koyama, Odawara, all of Japan

[73] Assignees: Nippon Steel Corporation; Mikuni Corporation, both of Tokyo, Japan

[21] Appl. No.: 846,169

[22] Filed: Apr. 29, 1997

Related U.S. Application Data

[63] Continuation of Ser. No. 551,875, Oct. 16, 1995, abandoned.

[30] Foreign Application Priority Data

Oct. 17, 1994 [JP] Japan ..... 6-276986

[51] Int. Cl.[6] ..... H01Q 13/10

[52] U.S. Cl. ..... 343/771; 343/770; 29/600

[58] Field of Search ..... 343/771, 770, 343/767, 768; 29/600; H01Q 13/10

[56] References Cited

U.S. PATENT DOCUMENTS

| | | | |
|---|---|---|---|
| 2,981,949 | 4/1961 | Elliott | 343/770 |
| 3,778,735 | 12/1973 | Steenmetser | 29/600 |
| 4,499,474 | 2/1985 | Muhs, Jr. et al. | 343/771 |
| 5,028,891 | 7/1991 | Lagerlöf | 343/771 |

FOREIGN PATENT DOCUMENTS

| | | | |
|---|---|---|---|
| 2319786 | 10/1973 | Germany | 343/771 |

OTHER PUBLICATIONS

Hirokawa et al., Single Layer Slotted Leaky Waveguide Array for Mobile DBS Reception, Technical Report of IEICE A.P. 93-25, vol. 93, No. 40, 1993.

*Primary Examiner*—Hoanganh T. Le

*Attorney, Agent, or Firm*—Pollock, Vande Sande & Priddy

[57] ABSTRACT

A slotted leaky waveguide array antenna comprises a flat, thin bottom plate made of a metallic material; a flat, thin slotted plate made of a metallic material, and disposed parallel with the bottom plate at a predetermined distance from the bottom plate to form a space between the slotted plate and the bottom plate, the slotted plate being formed with a plurality of slots arranged in substantially parallel rows extending in a predetermined guide axial direction; a plurality of flat, thin side walls made of a metallic material and arranged in the space so as to partition the space between the bottom plate and the slotted plate into a plurality of waveguides communicating with each other and including radiation waveguides extending in parallel in the guide axial direction, a lower surface of each of the side walls being fixed to the bottom plate and an upper surface thereof being fixed to the slotted plate; and an electrically conductive adhesive agent layer between the upper surface of each of the side walls and the slotted plate for fixing them to each other.

17 Claims, 7 Drawing Sheets

SLOTTED LEAKY WAVEGUIDE ARRAY ANTENNA AND A METHOD OF MANUFACTURING THE SAME

This application is a continuation of U.S. patent application Ser. No. 08/551,875, filed Oct. 16,1995, now abandoned.

BACKGROUND OF THE INVENTION

1. Field of the Invention

The present invention relates to a slotted leaky waveguide array antenna and to a method of manufacturing the same. More particularly, it relates to a slotted leaky waveguide array antenna that is suitable for use as a satellite broadcasting receiving antenna and is mounted in/on moving objects, and to a method of manufacturing such an antenna.

2. Description of the Related Art

"Single-layer Slotted Leaky Waveguide Array for Mobile DBS Reception", by J. Hirokawa et al., The Institute of Electronics, Information, and Communication Engineers of Japan, Technical Report of IEICE, Vol. 93, No. 40, A•P 93-25 1993, is intended to be used as a satellite broadcasting receiving antenna with a tilt angle which is mounted in moving objects such as vehicle, ship, and the like. In such an antenna, a crossing slot is used as a slot.

The above antenna has, in order to efficiently transmit and receive electromagnetic waves having a center frequency of, for example, 11.85 GHz, a plurality of radiation waveguides which are closely arranged in parallel, a feed waveguide coupled with one end of each of the radiation waveguides in order to combine radio waves received by the plurality of radiation waveguides; and a feed probe for feeding a reception radio wave combined by the feed waveguide to a converter. Each of the radiation waveguides comprises a leaky waveguide in which a plurality of crossing slots are arranged on the upper surface in the guide axial direction and a circularly polarized radiation matching slot is formed at a termination opposite to the one end to which the feed waveguide is coupled. The coupling between each radiation waveguide and the feed waveguide is performed through a $\pi$ branch including a coupling window and an inductive post.

Examples of a structure of the above-mentioned antenna and a method of manufacturing such an antenna, are disclosed in U.S. patent application Ser. No. 08/169,215, filed on Dec. 20, 1993, by M. Uematsu et al., entitled "Slotted Leaky Waveguide Array Antenna" and U.S. patent application Ser. No. 08/379,542, filed on Jan. 31, 1995, by M. Moriya et al., entitled "Antenna of Waveguide Structure and A Method of Manufacturing the Same" based on PCT/JP 94/00570, filed on Apr. 6, 1994. The contents of these U.S. patent applications are incorporated herein by reference.

In U.S. patent application Ser. No. 08/379,542, the antenna is formed by dividing it into an upper slotted plate and a lower section which are connected together. The lower section includes a bottom plate forming bottom surfaces of a plurality of radiation waveguides and a feed waveguide and side walls of the radiation waveguides and feed waveguide which stand vertically on the bottom plate. The lower section is integrally formed of a metallic material such as aluminium alloy, copper, or the like by casting, for example, by a die-casting method. The slotted plate is formed of a flat plate made of the same metallic material as that of the bottom plate. The crossing slots and the circularly polarized matching slots on the upper surface of each radiation waveguide are formed at predetermined positions by punching. The upper surfaces of the side walls of the lower section and the lower surface of the slotted plate are mechanically and electrically joined by spot welding using, for example, a laser beam, thereby forming a desired slotted leaky waveguide array antenna.

An interval of the spot welding is set to a value that is equal to or less than 1/10 of an applied frequency band in order to obtain desired electrical characteristics. For example, in the case where the center frequency is 11.85 GHz, the interval is set to a value that is equal to or less than 2 to 3 mm. Therefore, since the number of spot welding portions is several thousands per one antenna, it raises the problem such that it takes several tens of minutes for the welding operation and is not suitable for a mass production.

SUMMARY OF THE INVENTION

It is an object of the present invention to provide a slotted leaky waveguide array antenna including a lower section and a slotted plate so structured that the time necessary for the joining operation of a lower section and a slotted plate is short and thus is suitable for mass production.

Another object of the invention is to provide a method of manufacturing the slotted leaky waveguide array antenna having the above construction.

The slotted leaky waveguide array antenna of the invention includes a flat and thin bottom plate made of a metallic material; a flat and thin slotted plate made of a metallic material, arranged in parallel at the bottom plate with a predetermined interval from the bottom plate so as to provide a space between the slotted plate and the bottom plate and formed with a plurality of slots arranged in a predetermined guide axial direction; a plurality of flat and thin side walls made of a metallic material and arranged in the space so as to partition the space between the bottom plate and the slotted plate for defining a plurality of waveguides communicating with each other, wherein upper surfaces of the side walls are fixed to the bottom plate and lower surfaces thereof are fixed to the slotted plate; and an electrically conductive adhesive agent layer disposed between the upper surface of each of the side walls and the slotted plate for adhering them to each other.

In a preferred embodiment of the present invention, the conductive adhesive agent layer has a two-layer structure of a thermosetting electrically conductive adhesive agent.

According to the invention, a method of manufacturing a slotted leaky waveguide array antenna having a plurality of radiation waveguides which are closely arranged in parallel in a predetermined guide axial direction and formed in an upper surface of each of the waveguides with a plurality of slots arranged in the guide axial direction, comprises the steps of: preparing a lower section made of a metallic material and including one bottom plate defining bottom surfaces of the plurality of radiation waveguides and a plurality of side wall plates constructing side walls of the plurality of radiation waveguides, wherein the plurality of side wall plates are arranged in parallel so as to vertically extend on the bottom plate and the lower surface of each of the side walls is fixed to the bottom plate; preparing a flat and thin slotted plate made of a metallic material and formed with slots having a predetermined shape at predetermined portions; coating an electrically conductive adhesive agent at selected portions of the lower section or the slotted plate, wherein the selected portions are the upper surfaces of the plurality of side walls of the lower section or the portions on the slotted plate to be joined with the upper surfaces of the plurality of side walls; and joining and fixing the upper surfaces of the plurality of side walls of the lower section to the slotted plate via the conductive adhesive agent.

In the preferred embodiment of the present invention, the step of coating the electrically conductive adhesive agent includes coating a first layer of the thermosetting electrically conductive adhesive agent, hardening the first layer with a heat and, after that, coating a second layer of the same conductive adhesive agent as that of the first layer.

Since the slotted leaky waveguide array antenna according to the invention has such a construction that the upper surface of each of the plurality of side walls provided in the lower section is fixedly adhered to the predetermined portions of the slotted plate by the electrically conductive adhesive agent, a strong coupling between them can be obtained without deteriorating the electrical characteristics of the antenna and the manufacturing time can be remarkably reduced as compared with that of a conventional antenna in which the side walls of the lower section and the slotted plate are connected by welding or by screws. Particularly, as in the preferred aspect of the invention, in case of using the electrically conductive adhesive agent of the two-layer structure, the deterioration of the electrical characteristics of the antenna which may occur because the adhesive agent flows out inside the waveguide can be easily prevented.

DESCRIPTION OF THE PREFERRED EMBODIMENTS

Figure 1:
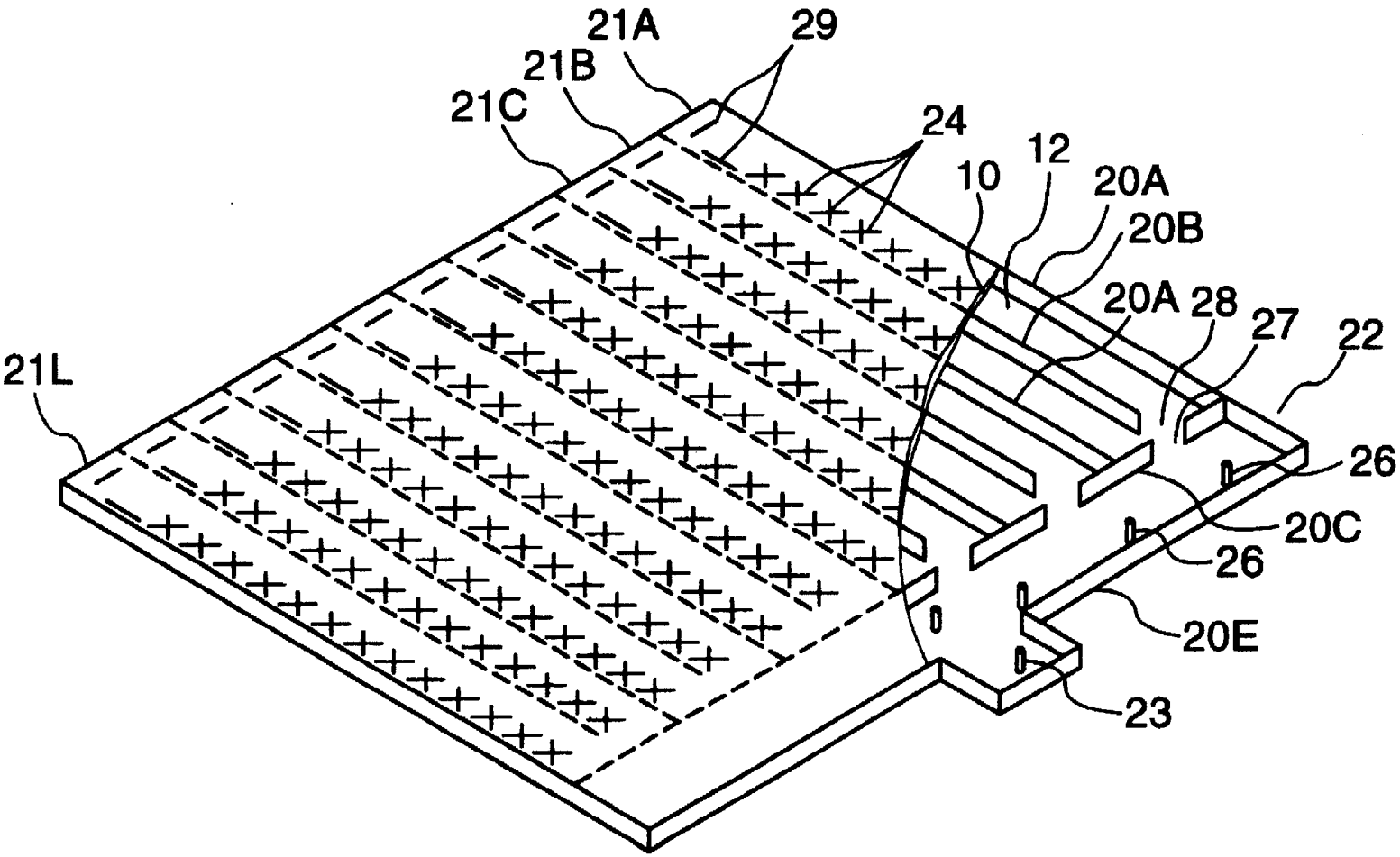
FIG. 1 is a perspective view showing a construction of a slotted leaky waveguide array antenna according to an embodiment of the present invention.

A structure of a slotted leaky waveguide array antenna according to an embodiment of the invention will now be described with reference to FIG. 1. An external view of the structure of the antenna is the same as that disclosed in U.S. patent application Ser. No. 08/169,215. As shown in FIG. 1, such an antenna has a plurality of radiation waveguides 21A to 21L which are adjacently arranged in parallel; a feed waveguide 22 which is coupled with one end of each of the radiation waveguides in order to combine radio waves received by the radiation waveguides and which extends in a direction perpendicular to the longitudinal axial direction of the radiation waveguide; and a feed probe 23 for feeding a received radio wave combined by the feed waveguide to a converter (not shown). On the upper surface of each of the radiation waveguides, a plurality of crossing slots 24 are arranged in the guide axial direction and a circularly polarized matching slot 29 is formed on a termination opposite to the end to which the feed waveguide is coupled. The coupling between each of the radiation waveguides and the feed waveguide is performed through a $\pi$ branch 28 including a coupling window 27 and an inductive post 26.

The radiation waveguides 21A to 21L are formed by isolating a narrow space formed between a common bottom plate 12 providing the respective bottom surfaces of the radiation waveguides and a slotted plate 10 arranged in parallel with the bottom plate 12 by a plurality of longitudinal side walls 20A and 20B which stand vertically on the bottom plate 12 and extend in parallel to each other. The respective ends of the radiation waveguides 21A to 21L are separated from the feed waveguide 22 by a plurality of short lateral side walls 20C which are linearly arranged with intervals 27 serving as coupling windows. The other ends of the radiation waveguides are closed by a common long lateral side wall 20D. Each longitudinal side wall 20A is fixed to the center portion of one of the short lateral side walls. Each longitudinal side wall 20B is made slightly shorter than the longitudinal side wall 20A, thereby forming the $\pi$ branch 28 which couples a pair of radiation waveguides to the feed waveguide in cooperation with the coupling window 27 and the inductive post 26. The feed waveguide 22 is surrounded by the short lateral side walls 20C, a lateral side wall 20E extending in parallel with the lateral side walls 20C, and the longitudinal side walls 20A of the radiation waveguides 21A and 21L existing in both sides.

The slotted plate 10 forms respective upper surfaces of the radiation waveguides. Bottom and upper surfaces of the feed waveguide 22 are formed by extending portions of the bottom plate 12 and slotted plate 10.

Figure 2:
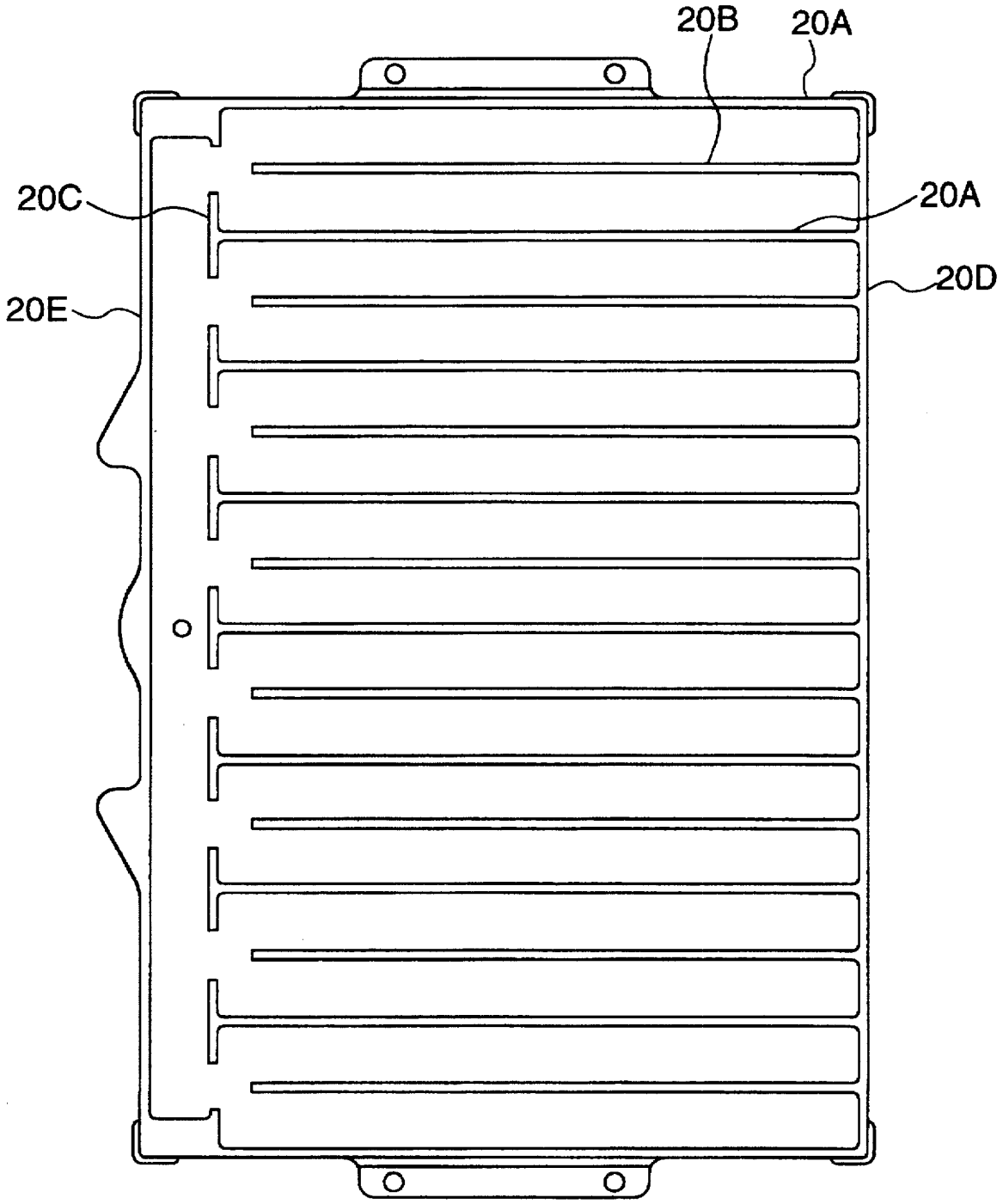
FIG. 2 is a plan view showing a construction of a lower section.

The bottom plate 12 which forms the bottom surfaces of the plurality of radiation waveguides 21A to 21L and feed waveguide 22 and the side walls 20A, 20B, 20C, 20D, and 20E of the radiation waveguides and the feed waveguide are integrally formed of a metallic material such as aluminium alloy, copper, or the like by casting, for example, by a die-casting method, thereby constructing a lower section of the antenna as shown in FIG. 2. The slotted plate is formed of a flat plate made of the same metallic material as that of the bottom plate. The crossing slots and the circularly polarized matching slot on the upper surface of each radiation waveguide are formed in the slotted plate at the predetermined positions by punching.

As the dimensions of the respective portions, for example, the width of each radiation waveguide is set to 17 mm, the width of the feed waveguide is set to 34 mm, a thickness of the bottom plate is set to 1.5 mm, the thickness of the slotted plate is set to 0.3 mm, the thickness of the side wall is set to 1.0 mm, and the height of the side wall is set to 4.0 mm.

The structure of the slotted plate and lower section formed as mentioned above is the same as that of the conventional antenna. A method of joining of the slotted plate and lower section will now be described hereinbelow.

Figure 3A:
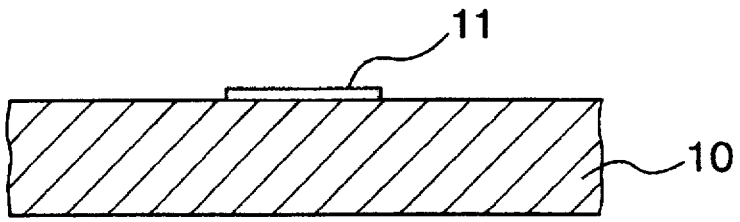
FIGS. 3A and 3B are diagrams for explaining a method of joining a slotted plate and side walls of the lower section by using an adhesive agent layer of a single-layer structure.
Figure 3B:
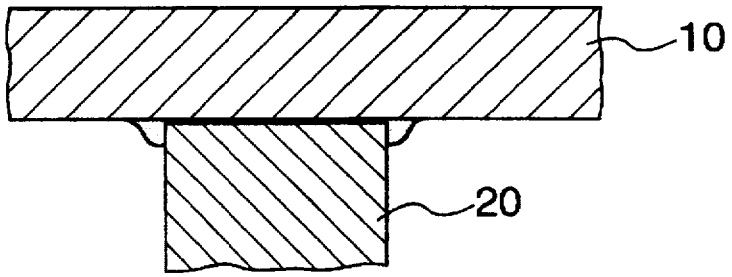

First, the case of joining by an adhesive agent layer of a single-layer structure will now be described with reference to FIGS. 3A and 3B. As shown in FIG. 3A, a layer 11 of a thermosetting electrically conductive adhesive agent is coated to portions of the back surface of the slotted plate 10 to be joined to the upper surfaces of the side walls of the lower section at a width corresponding to the width of upper surface of each side wall and a predetermined thickness. The layer 11 of the conductive adhesive agent is coated by a screen printing of a mimeographing system. A screen of mesh #200 made of a synthetic resin such as, for example, polyethylene terephthalate commercially available as Tetron (trade name) is used, while masking portions other than these to which the adhesive agent by coating a proper emulsion.

A thickness of the electrically conductive adhesive agent as coated is set to about 30 μm. This thickness is adjusted by the thickness of the emulsion coated for masking. That is, since the thickness of screen is extremely small and can be ignored, in case of coating the adhesive agent at a thickness of 30 μm, the thickness of the emulsion for the mask is selected to be 30 μm. In the case where the width of each side wall 20 of the lower section is fixed is 2 mm, the width of the adhesive agent as coated is one-half of the width, namely, about 1 mm. As the electrically conductive adhesive, a synthetic resin adhesive agent containing fine silver particles as metallic particles which is commercially available as, Three Bond 3301 or P1106 (trade name) of Tokuriki Chemical Co. Ltd., is used by adding thereto an epoxy resin as a binder. The electrically conductive adhesive may be any adhesive material having an electrical conductivity after hardening not less than the conductivity of the side walls.

Subsequently, the slotted plate and the lower section are assembled so that the upper surfaces of the side walls 20 of the lower section to be joined are brought into contact with portions of the lower section where the conductive adhesive agent layer 11 is coated. The assembly is heated in a heating furnace to a state in which the slotted plate is pressed against the lower section so that a pressure of about 10 kg/cm$^2$ is applied to the conductive adhesive agent layer 11, thereby hardening the conductive adhesive agent. It is assumed that the heating temperature at this time is about 160° C. and the heating time is about 3.5 hours in consideration of the fact that the heat capacity of the lower section is large. Although the joining power between the slotted plate and lower section as joined in this manner is sufficient, the adhesive agent may slightly flow,as shown in FIG. 3B, in the lateral direction outside of the side wall, namely, inside the radiation waveguide. Although, the electrical characteristics of the antenna may slightly deteriorate, this is not so serious as to prevent the antenna from practical use.

In order to prevent the adhesive agent from flowing out in the lateral direction, it is desirable to use an adhesive agent of a two-layer structure. A manufacturing method using the adhesive agent of the two-layer structure will now be described hereinbelow with reference to FIGS. 4A and 4B.

A first layer 11 of the thermoseting electrically conductive adhesive agent is coated, in a manner similar to the case of using the adhesive agent of the single-layer structure, as shown in FIG. 3A, to portions of the back surface of the slotted plate to be joined to the upper surfaces of the side walls of the lower section by the screen printing at a width corresponding to the width of upper surface of each of the side walls and a predetermined thickness. In the case of using the adhesive agent of the two-layer structure, the width of the first layer is selected to the same width of 1 mm as in the case of the single-layer structure, but the thickness is set to 20 μm.

Figure 4A:
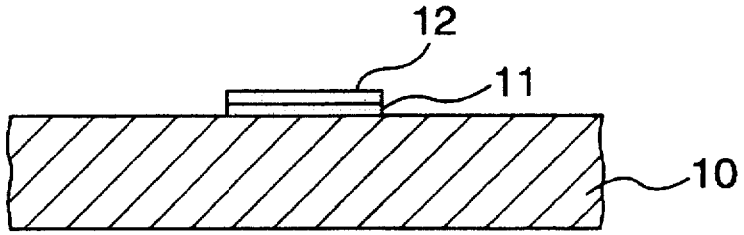
FIGS. 4A and 4B are diagrams for explaining a method of joining the slotted plate and the side walls of the lower section by using an adhesive agent layer of a two-layer structure.

The slotted plate 10 having the conductive adhesive agent layer 11 coated on its back surface is held in a furnace at a high temperature (about 150° C.) for a predetermined period of time (about 30 minutes), thereby hardening the conductive adhesive agent layer 11. Subsequently, a conductive adhesive agent layer 12 of an upper layer is coated on the hardened conductive adhesive agent layer 11 at a thickness of about 20 μm by using the same screen of the mimeographic system as that used at the time of the slot printing (FIG. 4A). The same adhesive agent as that used to form the lower layer is used to form the conductive adhesive agent of an upper layer.

Before the upper conductive adhesive agent 12 is hardened, the slotted plate and the lower section are assembled so that the upper surface of each side wall 20 of the lower section to be joined is contact with the upper conductive adhesive agent layer 12 as coated. The assembly is heated in a heating furnace in a state in which the slotted plate is pressed against the lower section so that a pressure of about 10 kg/cm$^2$ is applied to the conductive adhesive agent layer 12, thereby hardening the conductive adhesive agent. At this time, the heating temperature is set to about 160° C. and the heating time is set for about 3.5 hours considering the fact that the heat capacity of the lower section is large.

Figure 4B:
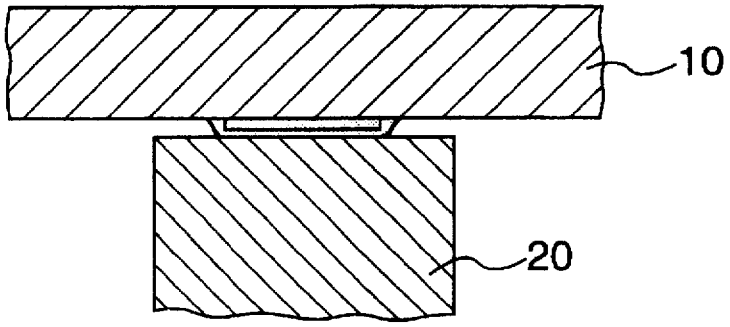

The upper conductive adhesive agent layer 12 before hardening flows in the lateral direction by the pressure and its lateral width is enlarged. Since the lower conductive adhesive agent layer 11 which has already been hardened exists under the layer 12, the fluid conductive adhesive agent flowing out in the lateral direction from the upper layer remains near the edge portions of the hardened lower conductive adhesive agent layer 11 as shown in FIG. 4B. The lateral width of the upper conductive adhesive agent layer 12 hardly increases over the lateral width of the lower layer 11.

As mentioned above, by using the adhesive agent layer of the two-layer structure, the flow-out of the adhesive agent in the lateral direction can be remarkably reduced as compared with the case where the adhesive agent layer of the single-layer structure is used.

Figure 5:
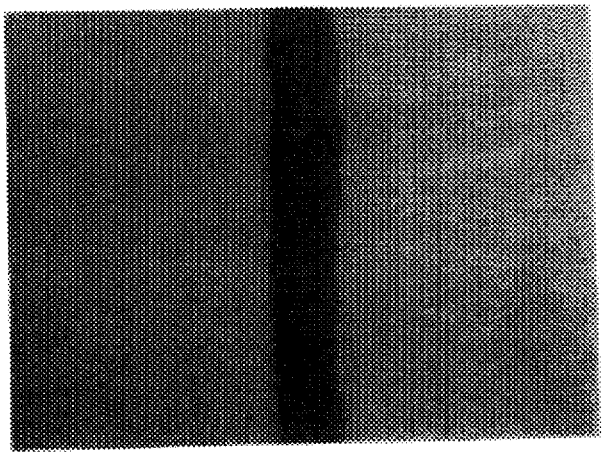
FIG. 5 is a photograph showing spreading in the lateral direction of the adhesive agent at a joint portion of the slotted plate and the lower section by using the adhesive agent layer of the single-layer structure.
Figure 6:
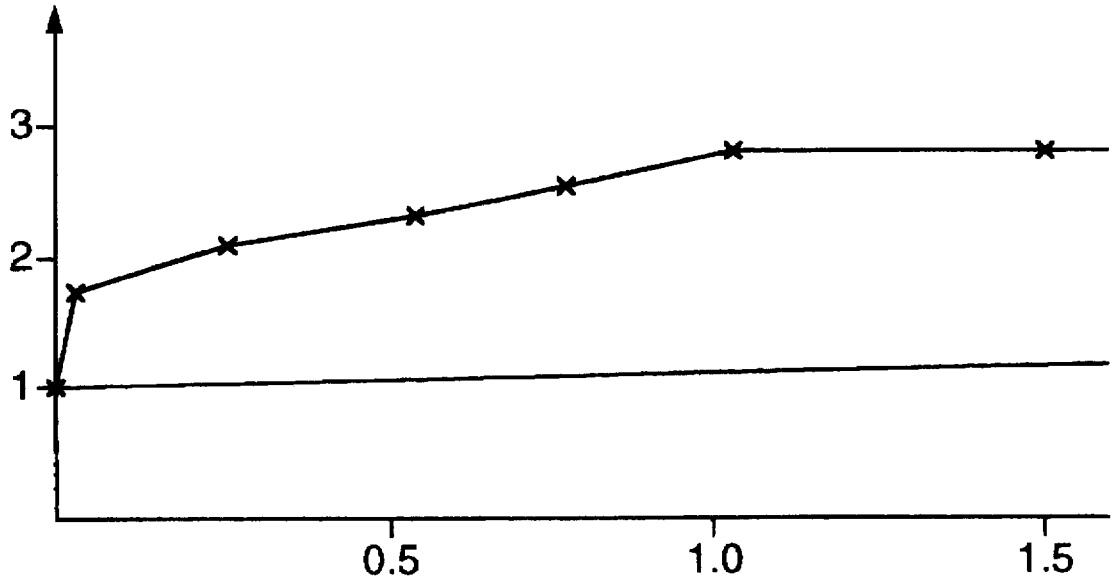
FIG. 6 is a graph showing the relation between a pressure that is applied to the joint portion of the slotted plate and the lower section in the first embodiment by using the adhesive agent layer of the single-layer structure and the spreading in the lateral direction of the adhesive agent.

In order to examine a state of the overflow of the adhesive agent layer of the single-layer structure, a conductive agent of only one layer having a width of 1 mm and a thickness of 30 μm is coated by the mimeographic type screen printing, a transparent acrylic plate is pressed to the adhesive agent, and the degree of the lateral spreading of the agent is observed. FIG. 5 shows a photograph of the result. By referring to FIG. 6 showing the relation between a pressure applied to the acrylic plate and the maximum width, it is known that the lateral width enlarges three times or more under the pressure of 1.5 kg corresponding to almost 10 kg/cm$^2$.

Figure 7A:
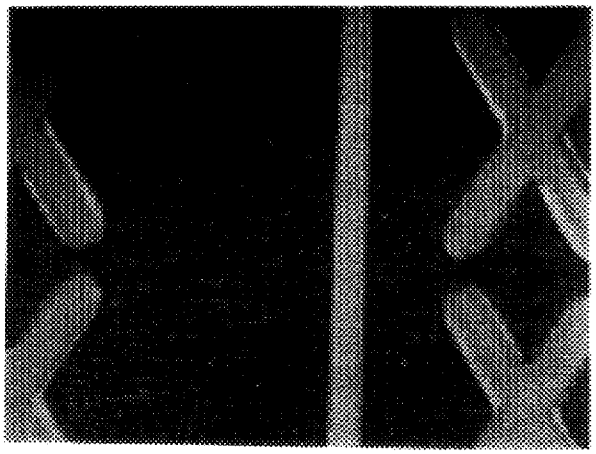
FIGS. 7A and 7B are photographs each showing spreading in the lateral direction of the adhesive agent in case of joining the slotted plate and the lower section by using the adhesive agent layer of the two-layer structure.
Figure 7B:
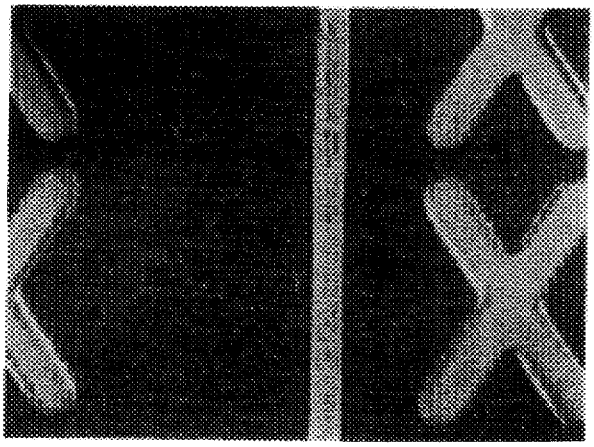

A rectilinear stripe portion extending vertically in the center in FIG. 7A shows a photograph showing a plan view of the conductive adhesive agent layer 11 of the lower layer in FIG. 4A. In the diagram, the X-shaped pattern is a crossing slot formed in the slotted plate by punching. A rectilinear stripe portion extending vertically is shown in the photograph of FIG. 7B and illustrate the spreading of the lateral width of the upper conductive adhesive agent layer 12 when the upper conductive adhesive agent layer 12 is coated on the lower conductive adhesive agent layer 11 as shown in FIG. 4B, and a transparent acrylic plate is placed thereon while applying a pressure of almost 10 kg/cm$^2$ thereto from the upper direction before thermal hardening. As will be obviously understood from the comparison between FIGS. 7A and 7B, the lateral width almost does not increase due to the existence of the hardened lower layer.

The time required for the screen printing of the first and second layers of the conductive adhesive agents is about one minute. The total time required for thermally hardening the first and second layers of the conductive adhesive agents is about 4 hours. However, since the thermal heat hardening can be simultaneously performed in a lump for thermal tens of slotted plates and several tens of leaky waveguides, the time required for thermal hardening per one slotted plate or leaky waveguide can be reduced to about few minutes. Thus, the time required for adhering per one article is reduced to a few minutes.

Figure 8A:
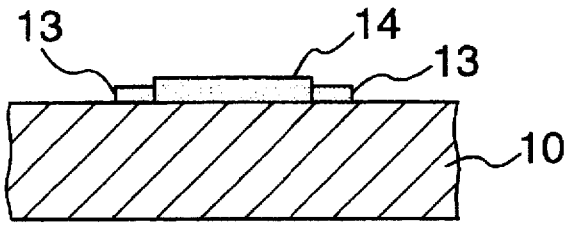
FIGS. 8A to 8C are diagrams for explaining a manufacturing method using a two-layer structure of adhesive agent according to another embodiment.
Figure 8B:
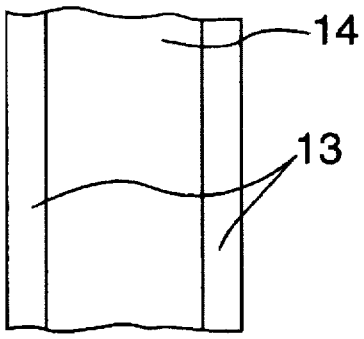

FIGS. 8A and 8B are diagrams for explaining an adhering process in another embodiment using an adhesive agent layer of the two-layer structure. FIG. 8A is a cross sectional view. FIG. 8B is a plan view. According to the adhering process, first, after the first layers 13 of an electrically conductive adhesive agent are formed in two rows on both sides of an adhering area of the slotted plate 10 by a screen printing, the layers 13 are thermally hardened. Subsequently, a second layer 14 of an electrically conductive adhesive agent is coated with a slightly larger layer thickness inside a space between two rows of the hardened first layer 13. By thermally hardening the second layer 14 while applying the pressure onto the upper surface of the corresponding side wall of the radiation waveguide, the side wall and the slotted plate are fixed. Although the lateral width of the second layer 14 of the conductive adhesive agent is urged to enlarge due to the pressure to the side wall, the enlargement of the lateral width is blocked by the hardened first layer 13 disposed on both sides. In this case, the width of the first layer 13 is about 0.3 mm and its thickness is about 20 μm. A width of the second layer 14 is about 0.7 to 0.8 mm and its thickness is about 20 μm.

Figure 8C:
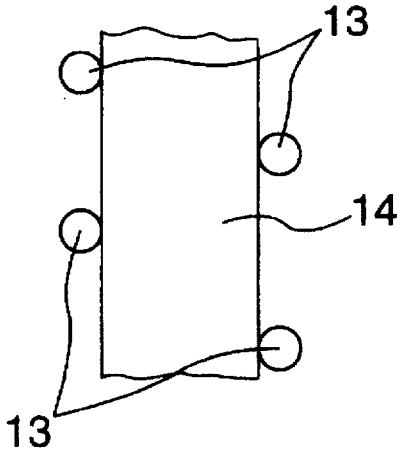

In place of continuously forming the first layer 13 of the conductive adhesive agent into continuous rows, as shown in FIG. 8C, the first layer 13 may be formed in two rows of discrete dots on both sides of the area where the second layer 14 of the electrically conductive adhere agent is to be formed, thereby blocking the enlargement of the width of second layer 14. In this case, the diameter of each dot of the adhesive agent layer 13 is about 0.3 mm and an interval between two dots is about 4 mm.

In each of the above embodiments, the agent obtained by adding the epoxy resin as a binder into the adhesive agent containing silver particles as fine metallic particles has been used. However, for example, it is also possible to use a paste-like agent obtained by adding flux or binder, such as potassium hydrogensulfate, into an aluminium solder containing, for example, Al of 50%, Zn of 40%, Cu of 5%, and Si of 5%. In this case, the paste-like agent is coated by silk printing in a manner similar to the case of using the adhesive agent containing silver particles and the heating temperature for thermal hardening is about 400°–500° C.

In each of the above embodiments, although the adhesive agent is coated to the back surface of the slotted plate, the adhesive agent may be coated onto the upper surface of each side wall of the lower section.

As described in detail above, in the method of manufacturing the slotted leaky waveguide array antenna according to the invention, the lower section manufactured by an aluminium die-cast or the like and the slotted plate manufactured by punching are mechanically and electrically joined by using the electrically conductive adhesive agent. Therefore, it is possible to provide a manufacturing method in which a time required for the joining operation can be reduced and which is suitable for a mass production.

We claim:

1. A slotted leaky waveguide array antenna, comprising:

a flat, thin bottom plate made of a metallic material;

a flat, thin slotted plate made of a metallic material, and disposed parallel with said bottom plate at a predetermined distance from said bottom plate to form a space between said slotted plate and said bottom plate, said slotted plate being formed with a plurality of slots arranged in substantially parallel rows extending in a predetermined guide axial direction;

a plurality of flat, thin side walls made of a metallic material and arranged in said space to partition said space between said bottom plate and said slotted plate into a plurality of waveguides communicating with each other, said plurality of waveguides including radiation waveguides extending in parallel in said guide axial direction, wherein a lower surface of each of said side walls is fixed to the bottom plate and an upper surface thereof is fixed to the slotted plate; and an electrically conductive adhesive agent layer between said upper surface of each of said side walls and said slotted plate for fixing them to each other and having a width substantially corresponding to the width of said upper surface of each of said sidewalls.

2. An antenna according to claim 1, wherein said bottom plate and said plurality of side walls are formed in an integral lower section.

3. An antenna according to claim 1, wherein said plurality of waveguides further includes:

a feed waveguide electrically connected to one end of each of said radiation waveguides and extending in a direction perpendicular to said guide axial direction.

4. An antenna according to claim 3, wherein said plurality of slots are formed to be aligned in said guide axial direction in each of portions of said slotted plate facing said plurality of radiation waveguides, respectively.

5. A slotted leaky waveguide array antenna, comprising:

a flat, thin bottom plate made of a metallic material;

a flat, thin slotted plate made of a metallic material, disposed parallel with said bottom plate at a predetermined distance from said bottom plate to form a space between said slotted plate and said bottom plate, said slotted plate being formed with a plurality of slots arranged in a predetermined guide axial direction;

a plurality of flat, thin side walls made of a metallic material and arranged in said space so as to partition said space between said bottom plate and said slotted plate into a plurality of waveguides communicating with each other, wherein a lower surface of each of said side walls is fixed to the bottom plate and an upper surface thereof is fixed to the slotted plate;

an electrically conductive adhesive agent layer existing between said upper surface of each of said side walls and said slotted plate for fixing them to each other; and wherein said conductive adhesive agent layer has a two-layer structure of a thermosetting electrically conductive adhesive agent.

6. An antenna according to claim 5, wherein said two-layer structure of said conductive adhesive agent includes a first layer and a second layer which covers substantially wholly a surface of said first layer.

7. An antenna according to claim 5, wherein said two-layer structure of said conductive adhesive agent includes a first layer formed into at least two rows with a space therebetween and a second layer extending in the space.

8. An antenna according to claim 5, wherein said two-layer structure of said conductive adhesive agent includes a first layer formed into two rows of discrete dots with a space between the two rows and a second layer extending in the space.

9. A method of manufacturing a slotted leaky waveguide array antenna having a plurality of radiation waveguides closely arranged in parallel with a predetermined guide axial direction and wherein a plurality of slots are formed in an upper surface of each of said radiation waveguides so as to be aligned in said guide axial direction, said method comprising the steps of:

providing a lower section made of a metallic material and including a bottom plate defining bottom walls of said plurality of radiation waveguides and a plurality of sidewall plates integrally formed with said bottom plate and constituting respective sidewalls of said plurality of radiation waveguides, wherein said plurality of sidewall plates are arranged parallel so as to stand vertically on said bottom plate and a lower surface of each of said sidewall plates is fixed to said bottom plate;

providing a flat, thin slotted plate made of a metallic material and having slots of a predetermined shape formed in predetermined portions;

coating an electrically conductive adhesive agent at selected portions of at least one of said lower section and said slotted plate, wherein said selected portions are upper surfaces of said plurality of sidewall plates of said lower section or portions of said slotted plate to be Joined to the upper surfaces of said plurality of sidewall plates and said conductive adhesive agent is coated on each of said selected portions at a width corresponding to the width of the upper surface of each of said sidewall plates; and joining and fixing the upper surfaces of said plurality of sidewall plates of said lower section to said slotted plate through said conductive adhesive agent.

10. A method according to claim 9, wherein said adhesive agent is coated by printing using a print screen of a mimeographing system.

11. A method according to claim 9, wherein said lower section is formed in an integral structure including said bottom plate and said side wall plates by casting said metallic material.

12. A method of manufacturing a slotted leaky waveguide array antenna having a plurality of radiation waveguides which are closely arranged in parallel with a predetermined guide axial direction, and wherein a plurality of slots are formed in an upper surface of each of said radiation waveguide so as to be aligned in said guide axial direction, said method comprising the steps of:

providing a lower section made of a metallic material and including a bottom plate providing a bottom surface of each of said plurality of radiation waveguides and a plurality of sidewall plates providing sidewalls of each of said plurality of radiation waveguides, wherein said plurality of sidewall plates are arranged in parallel so as to stand vertically on said bottom plate and a lower surface of each of said sidewall plates is fixed to said bottom plate;

providing a flat, thin slotted plate made of a metallic material and having slots of a predetermined shape formed in predetermined portions;

coating an electrically conductive adhesive agent at selected portions of at least one of said lower section and said slotted plate;

joining and fixing the upper surfaces of said plurality of sidewall plates of said lower section to said slotted plate through said conductive adhesive agent; and wherein said coating said adhesive agent includes the steps of coating a first layer of a thermosetting conductive agent to said selected portions of said at least one of said lower section and said slotted plate; and coating, after thermally hardening said first layer, a second layer of the same conductive adhesive agent as that of said first layer onto said hardened first layer.

13. A method according to claim 12, wherein the step of joining and fixing said upper surfaces of said plurality of side walls of said lower section to said slotted plate includes the step of:

assembling said slotted plate and said lower section with a predetermined positional relation between them before said second layer is thermally hardened and, subsequently, thermally hardening said second layer while applying pressure to said second layer disposed between said slotted plate and said lower section.

14. A method of manufacturing a slotted leaky waveguide array antenna having a plurality of radiation waveguides which are closely arranged in parallel with a predetermined guide axial direction, and wherein a plurality of slots are formed in an upper surface of each of said radiation waveguide so as to be aligned in said guide axial direction, said method comprising the steps of:

providing a lower section made of a metallic material and including a bottom plate providing a bottom surface of each of said plurality of radiation waveguides and a plurality of sidewall plates providing side walls of each of said plurality of radiation waveguides, wherein said plurality of sidewall plates are arranged in parallel so as to stand vertically on said bottom plate and a lower surface of each of said sidewall plates is fixed to said bottom plate;

providing a flat, thin slotted plate made of a metallic material and having slots of a predetermined shape formed in predetermined portions;

coating an electrically conductive adhesive agent at selected portions of at least one of said lower section and said slotted plate;

joining and fixing the upper surfaces of said plurality of sidewall plates of said lower section to said slotted plate through said conductive adhesive agent; and wherein said coating said adhesive agent includes the steps of coating a first layer of a thermosetting electrically conductive adhesive agent to an edge portion of each of said selected portions of said lower section or said slotted plate; and coating, after thermally hardening said first layer, a second layer of the same conductive adhesive agent as that of said first layer at an area surrounded by said hardened first layer.

15. A method according to claim 14, wherein the step of joining and fixing the upper surfaces of said plurality of side wall plates of said lower section to said slotted plate includes the step of:

assembling, before thermally hardening said second layer, said slotted plate and said lower section with a predetermined positional relation between them and, subsequently, thermally hardening said second layer, while applying a pressure to said second layer disposed between said slotted plate and said lower section.

16. A method according to claim 14, wherein said first layer is coated as a row of a plurality of discrete dots.

17. A method according to claim 16, wherein the step of joining and fixing the upper surfaces of said plurality of sidewall plates of said lower section to said slotted plate includes the step of:

assembling, before thermally hardening said second layer, said slotted plate and said lower section with a predetermined positional relation between them and, subsequently, thermally hardening said second layer, while applying a pressure to said second layer disposed between said slotted plate and said lower section.

* * * * *

UNITED STATES PATENT AND TRADEMARK OFFICE

CERTIFICATE OF CORRECTION

PATENT NO. : 5,745,083
DATED : April 28, 1998
INVENTOR(S) : UEMATSU et al.

It is certified that error appears in the above-identified patent and that said Letters Patent is hereby corrected as shown below:

On the title page, [22] - change "Filed: April 29, 1997" to --Filed: April 28, 1997--.

Signed and Sealed this

Twenty-fifth Day of August, 1998

Bruce Lehman

*Attest:*

BRUCE LEHMAN

*Attesting Officer*

*Commissioner of Patents and Trademarks*